US008573253B2

(12) United States Patent
Ogami et al.

(10) Patent No.: US 8,573,253 B2
(45) Date of Patent: Nov. 5, 2013

(54) VALVE ASSEMBLY FOR GAS CONTAINER

(75) Inventors: Nobuyuki Ogami, Anjo (JP); Nobuo Kobayashi, Toyota (JP); Akira Yamashita, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 1156 days.

(21) Appl. No.: 11/884,129

(22) PCT Filed: Feb. 20, 2006

(86) PCT No.: PCT/JP2006/003516

§ 371 (c)(1),
(2), (4) Date: Aug. 10, 2007

(87) PCT Pub. No.: WO2006/093060

PCT Pub. Date: Sep. 8, 2006

(65) Prior Publication Data

US 2008/0105310 A1 May 8, 2008

(30) Foreign Application Priority Data

Mar. 1, 2005 (JP) ..... 2005-056071

(51) Int. Cl.
*F17C 1/00* (2006.01)
*F17C 13/04* (2006.01)
*B67D 7/36* (2010.01)

(52) U.S. Cl.
USPC ..... 137/597; 137/590; 137/592; 141/18; 220/582; 222/3

(58) Field of Classification Search
USPC ..... 137/577, 590, 597, 961, 588, 592, 137/596.12, 599.11; 222/3, 189.06; 141/18; 220/581, 582
See application file for complete search history.

(56) References Cited

U.S. PATENT DOCUMENTS 3,307,597 A * 3/1967 Shugarman ..... 141/18
4,006,205 A * 2/1977 Etter ..... 261/39.1

(Continued)

FOREIGN PATENT DOCUMENTS

EP 1 275 548 A 1/2003
JP 11-218297 A 8/1999

(Continued)

*Primary Examiner* — Craig Schneider
*Assistant Examiner* — Atif Chaudry
(74) *Attorney, Agent, or Firm* — Kenyon & Kenyon LLP

(57) ABSTRACT

There is disclosed a valve assembly for a gas container capable of appropriately discharging a gas from the gas container, even if a valve of a discharge passage has a failure or the like. The valve assembly for the gas container disposed at the gas container has, as passages which allow the inside of the gas container to communicate with the outside, a filling passage which fills the gas container with the gas and a discharge passage which discharges the gas. Furthermore, the valve assembly has a filling-side valve disposed at the filling passage and configured to close this passage, a discharge-side valve disposed at the discharge passage and configured to close this passage, a communication path which connects a downstream side of the discharge-side valve to a downstream side of the filling-side valve, and a shut-off valve disposed at the communication path. When the discharge-side valve does not open due to the failure or the like, the shut-off valve is opened to allow the gas to flow through the filling passage, the communication path and the discharge passage in this order.

22 Claims, 6 Drawing Sheets

(56) References Cited

U.S. PATENT DOCUMENTS

| | | | | |
|---|---|---|---|---|
| 4,583,372 | A | 4/1986 | Egan et al. | |
| 5,193,580 | A | 3/1993 | Wass et al. | |
| 5,197,710 | A | 3/1993 | Wass et al. | |
| 5,309,945 | A * | 5/1994 | Sakai et al. | 137/861 |
| 5,738,145 | A * | 4/1998 | Daicho et al. | 137/878 |
| 5,992,219 | A * | 11/1999 | Otaka | 73/40.5 R |
| 6,041,762 | A | 3/2000 | Sirosh et al. | |
| 6,314,986 | B1 * | 11/2001 | Zheng et al. | 137/240 |
| 6,557,821 | B2 | 5/2003 | Girouard et al. | |
| 6,691,729 | B2 * | 2/2004 | Takeda et al. | 137/74 |
| 6,766,829 | B2 * | 7/2004 | Takeda et al. | 137/877 |
| 7,013,916 | B1 * | 3/2006 | Pearlstein et al. | 137/613 |
| 2003/0102051 | A1 * | 6/2003 | Hasaka et al. | 141/325 |

FOREIGN PATENT DOCUMENTS

| | | | |
|---|---|---|---|
| JP | 2943980 | B2 | 8/1999 |
| JP | 2002-372197 | A | 12/2002 |
| JP | 2003-166700 | A | 6/2003 |
| JP | 2005-48918 | A | 2/2005 |
| WO | WO 03/054441 | A | 7/2003 |

* cited by examiner

VALVE ASSEMBLY FOR GAS CONTAINER

This is a 371 national phase application of PCT/JP2006/303516 filed 20 Feb. 2006, claiming priority to Japanese Patent Application No. 2005-056071 filed 1 Mar. 2005, the contents of which are incorporated herein by reference.

TECHNICAL FIELD

The present invention relates to a valve assembly disposed at a mouthpiece or the like of a gas container, more particularly to a valve assembly for a gas container having passages and valves to fill the gas container with gas and to discharge the gas.

BACKGROUND ART

Heretofore, it is known that various valves such as a shut-off valve and a check valve are integrated to constitute a valve assembly and that the valve assembly is attached to a mouthpiece of a gas container (e.g., see Patent Documents 1 to 4). For example, a gas filling passage of the valve assembly described in Patent Document 1 is provided with a check valve which inhibits outflow of gas from the gas container. A gas discharge passage of the valve assembly is provided with an electromagnetic shut-off valve which opens and closes this passage. The electromagnetic shut-off valve is positioned in the gas container, and the discharge passage and the filling passage are arranged independently of each other on a downstream side of the electromagnetic shut-off valve.

[Patent Document 1] U.S. Pat. No. 5,197,710 (FIG. 2)
[Patent Document 2] U.S. Pat. No. 5,193,580
[Patent Document 3] U.S. Pat. No. 6,557,821
[Patent Document 4] JP 2003-166700 A

DISCLOSURE OF THE INVENTION

In such a conventional valve assembly for a gas container, when the electromagnetic shut-off valve does not open owing to a failure or the like, gas stored in the gas container cannot be discharged to the outside via the discharge passage. During this failure, even if the gas is to be discharged from the filling passage, the gas cannot be discharged because the check valve is disposed.

An object of the present invention is to provide a valve assembly for a gas container capable of appropriately discharging gas from the gas container even in a case where a valve of a discharge passage has a failure or the like.

A valve assembly for a gas container of the present invention is disposed at the gas container and has a filling passage to fill the gas container with gas and a discharge passage to discharge the gas as passages which allow the inside of the gas container to communicate with the outside. The valve assembly has a filling-side valve which is disposed at the filling passage and which is configured to shut off the filling passage; a discharge-side valve which is disposed at the discharge passage and which is configured to shut off the discharge passage; a communication path which connects a downstream side of the discharge-side valve to a downstream side of the filling-side valve; and a communication shut-off mechanism which is configured to allow communication between the filling passage and the discharge passage allowed to communicate with each other via the communication path and to shut off the communication.

According to this constitution, to fill the container with the gas, when the filling-side valve is opened, the gas container is filled with the gas via the filling passage. To discharge the gas, when the discharge-side valve is opened, the gas is discharged from the gas container via the discharge passage. When the discharge-side valve is normal, the communication is shut off by the communication shut-off mechanism. In consequence, the filling passage can be disposed independently of the discharge passage, and the filling with the gas and the discharging of the gas can appropriately be performed.

On the other hand, even if the discharge-side valve does not open owing to the failure or the like, the communication is allowed by the communication shut-off mechanism. In consequence, the gas stored in the gas container can flow through the communication path from the downstream side of the filling passage (the downstream side of the filling-side valve) and flow into the downstream side of the discharge passage (the downstream side of the discharge-side valve) from the communication path. In consequence, since the communication path connecting the discharge passage to the filling passage is disposed at the above-mentioned position, it is possible to appropriately discharge the gas from the gas container via the discharge passage by effectively using the filling passage, even if the discharge-side valve does not open owing to the failure or the like.

Here, the downstream side of the filling passage and the downstream side of the filling-side valve are a downstream side as viewed from a gas flow direction in a case where the container is filled with the gas from the filling passage. Therefore, in view of a relation between the gas container and the passage, the inside of the gas container viewed from the filling-side valve is the downstream side of the filling-side valve, and the outside of the gas container viewed from the filling-side valve is an upstream side of the filling-side valve.

Similarly, the downstream side of the discharge passage and the downstream side of the discharge-side valve are a downstream side as viewed from a gas flow direction in a case where the gas is discharged from the discharge passage. Therefore, in view of a relation between the gas container and the passage, the outside of the gas container viewed from the discharge-side valve is the downstream side of the discharge-side valve, and the inside of the gas container viewed from the discharge-side valve is an upstream side of the discharge-side valve.

Here, the gas is, for example, a high-pressure combustible gas. The high-pressure combustible gas is, for example, a hydrogen gas or a compressed natural gas.

In the present invention described above, it is preferable that the communication shut-off mechanism comprises a shut-off valve disposed at the communication path.

According to this constitution, a small and simple valve assembly can be constituted.

In this case, it is preferable that the shut-off valve disposed at the communication path is a man-powered valve.

According to this constitution, it is possible to appropriately cope with electric abnormality of a system. Here, examples of the man-powered valve include a foot valve in addition to a manual valve described later.

In addition, according to one aspect of the present invention, the shut-off valve disposed at the communication path may be constituted of an electrically driven valve such as an electromagnetic valve.

Moreover, according to one aspect of the present invention, a communication shut-off mechanism in which any shut-off valve is not disposed at the communication path may be constituted. The communication shut-off mechanism comprises, for example, a plurality of shut-off valves disposed at the filling passage and the discharge passage. For example, to shut off the communication between the filling passage and the discharge passage, it is constituted that the shut-off valves are disposed on an upstream side and a downstream side of a position of a connection point between the filling passage and the communication path and that the shut-off valve is disposed on a downstream side of a connection point between the discharge passage and the communication path. Therefore, manual or automatic opening and closing of the plurality of shut-off valves become complicated, and a structure of the valve assembly itself is complicated. When the communication path is provided with the shut-off valve as in the above preferable constitution of the present invention, the communication shut-off mechanism can more simply be constituted.

It is preferable that the shut-off valve is a manual valve having a manual operating portion which opens and closes the communication path and that the manual operating portion is disposed outside the gas container.

According to this constitution, since the shut-off valve is the manual valve, the shut-off valve can be constituted to be compact. Since the manual operating portion is disposed outside the gas container, the manual operating portion can easily be accessed to open the shut-off valve during the failure of the discharge-side valve or the like.

Here, the manual operating portion may comprise, for example, a handle, a lever or a button.

Preferably, the discharge passage is provided with a pressure regulation valve on a downstream side of a connection combining point between the discharge passage and the communication path.

According to this constitution, since the pressure regulation valve is positioned on the downstream side of the connection combining point between the discharge passage and the communication path, the gas flowing through the discharge passage passes through the pressure regulation valve even during the failure that the discharge-side valve does not open. In consequence, even during this failure or the like, the pressure of the gas can be reduced (regulated) before the gas is discharged.

More preferably, the valve assembly for the gas container further comprises: a sensor which is disposed at the discharge passage on an upstream side of the pressure regulation valve and which detects a state quantity of the gas.

According to this constitution, since the sensor is disposed on the upstream side of the pressure regulation valve, a state of the gas stored in the gas container can be detected.

Alternatively, according to another preferable aspect, the discharge passage may be provided with a sensor which detects a state quantity of the gas on the downstream side of the discharge-side valve.

According to this constitution, the sensor can detect the state of the gas stored in the gas container in the same manner as described above. If the gas leaks from the sensor, the discharge-side valve on the upstream side of the sensor can be closed to inhibit the gas leakage from the sensor. Therefore, a seal structure of the sensor can be simplified.

Here, examples of the state quantity of the gas to be detected by the sensor include a pressure and a temperature of the gas. Therefore, examples of the sensor include a pressure sensor and a temperature sensor.

In the present invention described above, it is preferable that the filling-side valve is a check valve or a man-powered valve.

According to this constitution, when the filling-side valve is the man-powered valve, the filling-side valve may be operated to appropriately open or close during the filling with the gas or the discharging of the gas (including the failure time of the discharge-side valve or the like). On the other hand, when the filling-side valve is the check valve, without operating the filling-side valve, the gas is allowed to flow through the filling passage on the downstream side during the filling with the gas. Without operating the filling-side valve, it can be prevented that the gas stored in the gas container flows backwards through the filling passage and is discharged to the outside.

Alternatively, according to another preferable aspect, the valve assembly may further have a plurality of filling-side valves that may include check valves arranged in series in the filling passage.

According to this constitution, the plurality of check valves is arranged in series. Therefore, if one check valve has a failure or the like, counter flow of the gas can be inhibited by another check valve. That is, fail safe can be achieved.

Preferably, the discharge-side valve is an electrically driven valve.

Alternatively, according to another preferable aspect, the valve assembly may further have a plurality of discharge-side valves that may include an electrically driven valve and a man-powered valve positioned on a downstream side of the electrically driven valve.

According to this constitution, if the electrically driven valve and the man-powered valve do not open owing to the failure or the like, the communication may be allowed by the communication shut-off mechanism as described above to secure a flow path for discharging the gas. On the other hand, when the electrically driven valve does not close owing to the failure or the like, the man-powered valve on the downstream side of the electrically driven valve can be operated and closed to inhibit the discharge of the gas.

Here, examples of the electrically driven valve include an electromagnetic valve to be driven by a solenoid, an electromotive valve to be driven by a motor and a valve to be driven by an electric or magnetic force of a piezoelectric element, a magnetostrictive element or the like.

According to another preferable aspect, the discharge-side valve is a source valve of the gas container.

Preferably, the discharge passage is provided with a filter on an upstream side of the discharge-side valve.

According to this constitution, foreign matters can be trapped by the filter, and the gas from which the foreign matters have been removed can be discharged from the gas container. Since the filter is disposed on the upstream side of the discharge-side valve, the foreign matters in the gas can be prevented from being attached to the discharge-side valve. In consequence, it is possible to effectively avoid, for example, damages on the discharge-side valve due to the foreign matters during a valve closing operation.

Preferably, the valve assembly for the gas container of the present invention further has: a relief valve to be opened when the gas stored in the gas container reaches a predetermined pressure or more; and a relief passage which is provided with the relief valve and which allows the inside of the gas container to communicate with the outside, when the relief valve opens.

According to this constitution, when the inside of the gas container reaches an abnormally high pressure, the gas can be discharged from the gas container via the relief valve and the relief passage. In consequence, an inner pressure of the gas container can be reduced.

In this case, it is preferable that the relief passage is a passage connected to the filling passage so as to be branched from the filling passage and that the filling-side valve is positioned on an upstream side of a branch connection point between the relief passage and the filling passage.

According to this constitution, since the relief passage is connected to the filling passage so as to be branched from the filling passage, a size of the whole valve assembly can be reduced as compared with a case where the relief passage and the filling passage are arranged independently of each other. In consideration of the arrangement of the filling-side valve, the branch connection point is set as described above. In consequence, when the inside of the gas container reaches the abnormally high pressure, the gas can appropriately be guided to the downstream side of the relief passage and discharged.

Preferably, the valve assembly for the gas container of the present invention further includes a housing having the filling passage, the discharge passage, the filling-side valve, the discharge-side valve, the communication path and the communication shut-off mechanism.

Preferably, the filling passage allows the inside of the gas container to communicate with a gas filling line in a fuel cell system, and the discharge passage allows the inside of the gas container to communicate with a gas discharge line which discharges the gas to a fuel cell in the fuel cell system.

Another valve assembly for a gas container of the present invention is disposed at the gas container and has: a discharge passage of a gas which allows the inside of the gas container to communicate with the outside; a first gas passage which allows the inside of the gas container to communicate with the outside and which is different from the discharge passage; a discharge-side valve which is disposed at the discharge passage and which is configured to shut off the discharge passage; a first valve which is disposed at the first gas passage and which is configured to shut off the first gas passage; a communication path which connects a portion of the discharge passage outside the gas container as viewed from the discharge-side valve to a portion of the first gas passage in the gas container as viewed from the first valve; and a communication shut-off mechanism which is configured to allow communication between the first gas passage and the discharge passage which are allowed to communicate with each other via the communication path and to shut off the communication.

According to this constitution, when the discharge-side valve is normal, the communication shut-off mechanism shuts off the communication. In consequence, the first gas passage can be disposed independently of the discharge passage, and the gas can appropriately be discharged. Even if the discharge-side valve does not open owing to the failure or the like, the communication shut-off mechanism allows the communication. In consequence, the gas stored in the gas container flows through the communication path from the downstream side of the first gas passage (the portion of the first gas passage in the gas container as viewed from the first valve), and can flow into the discharge passage on the downstream side (the portion of the discharge passage outside the gas container as viewed from the discharge-side valve) from the communication path. In consequence, even if the discharge-side valve does not open owing to the failure or the like, the gas can appropriately be discharged from the gas container via the discharge passage by effectively using the first gas passage and the communication path.

Preferably, the first gas passage is a filling passage for filling the gas container with the gas, or a relief passage for discharging the gas when the gas stored in the gas container reaches a predetermined pressure or more.

According to this constitution, when the discharge-side valve does not open owing to the failure or the like, it is possible to appropriately discharge the gas from the gas container via the discharge passage by effectively using the filling passage or the relief passage.

It is more preferable that the communication shut-off mechanism comprises a shut-off valve disposed at the communication path.

According to this constitution, the communication shut-off mechanism can easily be constituted in the same manner as described above.

It is preferable that, the above gas container has a container body in which the gas is stored and a mouthpiece attached to the container body, and the valve assembly for the gas container of the present invention is disposed at the mouthpiece. More preferably, the valve assembly for the gas container is screwed into the mouthpiece.

According to the valve assembly for the gas container of the present invention described above, even if the valve of the discharge passage has the failure or the like, the gas can appropriately be discharged from the gas container.

BEST MODE FOR CARRYING OUT THE INVENTION

Figure 1:
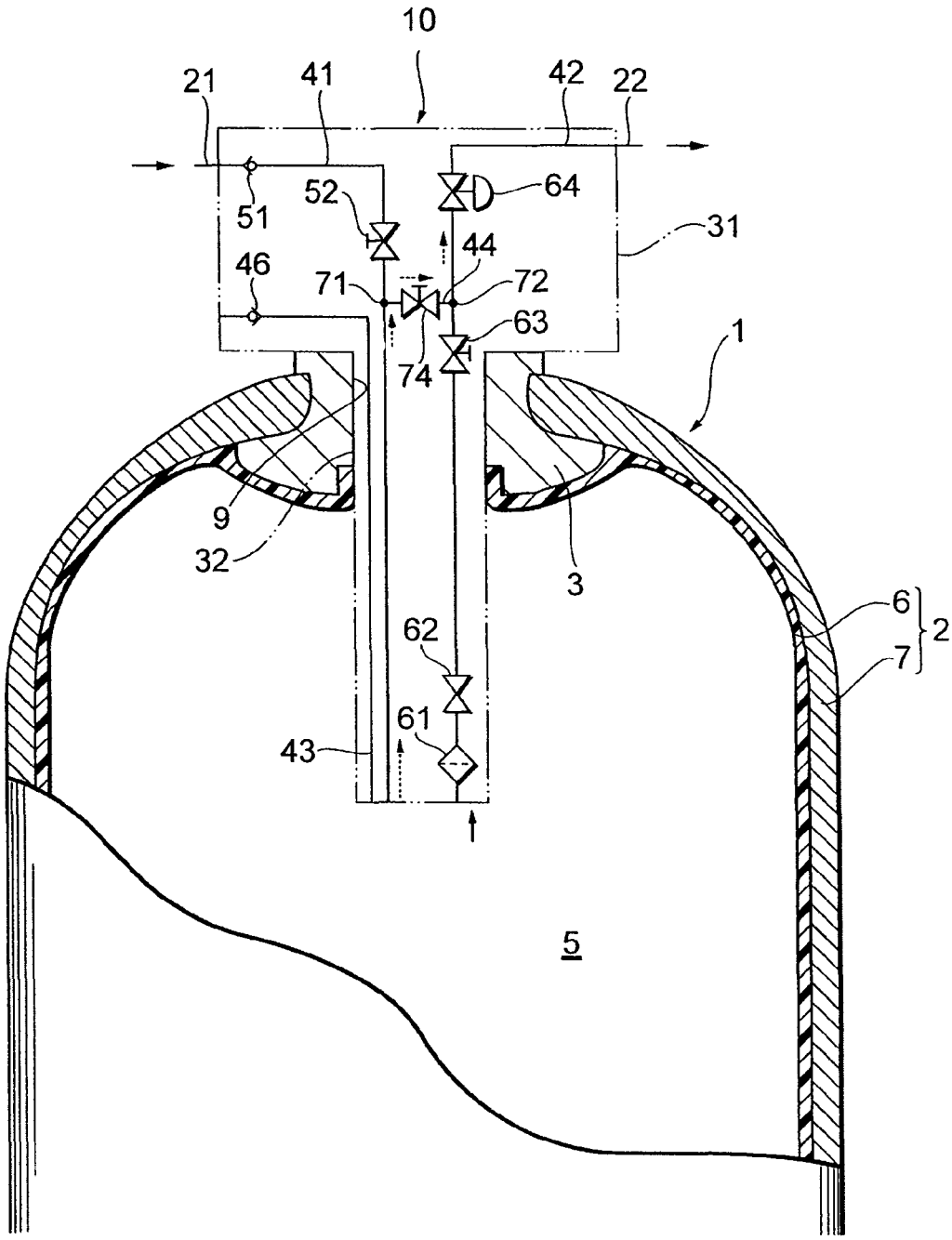
FIG. 1 is a diagram showing a constitution of a valve assembly for a gas container according to a first embodiment and showing a circuit system of the valve assembly together with a section of a part of the gas container.

A valve assembly for a gas container according to a preferable embodiment of the present invention will hereinafter be described with reference to the accompanying drawings. This valve assembly for the gas container allows the discharge passage to communicate with, for example, a filling passage, even if a discharge-side valve disposed on a discharge passage does not open owing to a failure or the like. In consequence, gas can be discharged from the gas container through the discharge passage. It is to be noted that in second and subsequent embodiments, parts common to those of the first embodiment are denoted with the same reference numerals as those of the first embodiment and description thereof is omitted.

First Embodiment

As shown in FIG. 1, a gas container 1 includes a container body 2 having a hermetically-sealed cylindrical shape as a whole, and a mouthpiece 3 attached to one end portion or opposite end portions of the container body 2 in a longitudinal direction. The inside of the container body 2 constitutes a storage space 5 in which various gases are stored. The gas container 1 may be filled with gas at normal pressure or gas having a pressure raised as compared with the normal pressure. That is, the gas container 1 of the present invention can function as a high-pressure gas container.

For example, in a fuel cell system, a pressure of a combustible fuel gas prepared under a high pressure is reduced for use in power generation of a fuel cell. The gas container 1 of the present invention is applicable to storage of the high-pressure fuel gas, and a fuel gas such as a hydrogen gas or a compressed natural gas (the CNG gas) may be stored in the container. A pressure of hydrogen with which the gas container 1 is filled is, for example, 35 MPa or 70 MPa, and a pressure of the CNG gas is, for example, 20 MPa.

The container body 2 is constituted of a double layer structure including an inner liner 6 (an inner shell) having a gas barrier property and a shell 7 (an outer shell) made of FRP with which the inner liner 6 is covered. The liner 6 is made of a resin such as highly dense polyethylene or a metal such as an aluminum alloy. The mouthpiece 3 is made of a metal such as stainless steel, and disposed at the center of an end wall portion of the container body 2 having a semispherical shape. An internal thread 9 is formed at an inner peripheral surface of an opening of the mouthpiece 3, and a valve assembly 10 is screwed into and connected to the internal thread.

The valve assembly 10 is a module in which, in addition to a gas passage, piping line elements such as valves and joints, various gas sensors and the like are integrally incorporated in a housing 31. The valve assembly 10 connects an external gas filling line 21 to the storage space 5, and also connects an external gas discharge line 22 to the storage space 5.

For example, in the gas container 1 of the fuel cell system, the storage space 5 is filled with, for example, a high-pressure hydrogen gas via the gas filling line 21 and the valve assembly 10. For example, the hydrogen gas stored in the storage space 5 is discharged from the gas container 1 of the fuel cell system to the gas discharge line 22 via the valve assembly 10. Moreover, the hydrogen gas is supplied to a fuel cell disposed at the gas discharge line 22. One example in which the gas container 1 is applied to a high-pressure hydrogen tank for the fuel cell will hereinafter be described.

The valve assembly 10 is disposed so as to communicate with the inside and the outside of the gas container 1. The valve assembly 10 has the housing 31 (the valve body) provided with various valves (46, 51, 52, 62, 63, 64 and 74) and various gas passages (41 to 44). An external thread 32 to be screwed into the internal thread 9 of the mouthpiece 3 is formed at an outer peripheral surface of a neck portion of the housing 31, and the valve assembly 10 can be screwed into and connected to the mouthpiece 3 via this thread portion. A gap between the screwed and connected housing 31 and mouthpiece 3 is air-tightly sealed with a plurality of seal members (not shown).

The housing 31 has, as passages which allow the inside of the gas container 1 to communicate with the outside, the filling passage 41 which allows the storage space 5 to communicate with the gas filling line 21, the discharge passage 42 which allows the storage space 5 to communicate with the gas discharge line 22, and the relief passage 43 disposed independently of the filling passage 41 and the discharge passage 42. The housing 31 also has a communication path 44 which connects the filling passage 41 to the discharge passage 42.

One end of the relief passage 43 opens to the outside at a head portion of the housing 31, and the other end of the relief passage opens in the storage space 5. The relief passage 43 is provided with a relief valve 46 which operates to open when the gas stored in the gas container 1 reaches a predetermined pressure or more.

The relief valve 46 operates when the pressure of the gas stored in the gas container 1 reaches a minimum operation pressure (the predetermined pressure), and is constituted of, for example, a spring (mechanical) type valve. According to such a constitution, when the inside of the storage space 5 reaches an abnormally high pressure, the relief valve 46 opens. Therefore, the gas stored in the storage space 5 can be discharged from the relief passage 43, and damages on the gas container 1 can be avoided. It is to be noted that the relief valve 46 may be a fusible plug valve which fuses so as to allow the relief passage 43 to communicate with the outside (the atmosphere) at a high temperature (when a predetermined temperature is reached).

One end of the filling passage 41 is connected to the gas filling line 21, and the other end of the filling passage opens in the storage space 5. The filling passage 41 is provided with a check valve 51 which inhibits counter flow of the gas and a manual valve 52 arranged in series with the check valve 51. These check valve 51 and manual valve 52 constitute "a filling-side valve" or "a first valve" mentioned in the present invention.

One end of the discharge passage 42 is connected to the gas discharge line 22 (or the fuel cell on a downstream side of the line), and the other end of the passage opens in the storage space 5. The discharge passage 42 is provided with, in order from a storage space 5 side, a filter 61 which traps foreign matters in the gas, the shut-off valve 62 capable of electrically opening or closing the discharge passage 42, a manual valve 63 capable of opening or closing the discharge passage 42 by a manual operation, and a pressure regulation valve 64 which reduces the pressure of the gas to regulate the pressure. These shut-off valve 62 and manual valve 63 constitute "discharge-side valves" mentioned in the present invention.

Here, in the present description, the downstream side of the filling passage 41 is a downstream side as viewed from a gas flow direction in the filling passage 41, in a case where the storage space 5 is filled with the gas from the gas filling line 21. Therefore, the check valve 51 is positioned on an upstream side (a primary side) of the manual valve 52. In other words, in view of a relation between the gas container 1 and the filling passage, the downstream side of the filling passage as viewed from the check valve 51 corresponds to the inside of the gas container 1, and the upstream side of the filling passage corresponds to the outside of the gas container 1.

Similarly, the downstream side of the discharge passage 42 is a downstream side as viewed from a gas flow direction in the discharge passage 42, in a case where the gas is discharged from the storage space 5 to the gas discharge line 22. Therefore, the discharge passage 42 is provided with, in order from the upstream side of the passage, the filter 61, the shut-off valve 62, the manual valve 63 and the pressure regulation valve 64. In other words, in view of a relation between the gas container 1 and the discharge passage, the upstream side of the discharge passage as viewed from the shut-off valve 62 corresponds to the inside of the gas container 1, and the upstream side of the discharge passage corresponds to the outside of the gas container 1.

Elements such as the valves constituting the valve assembly 10 will be described.

The check valve 51 allows the gas to flow through the filling passage 41 on the downstream side, in a case where the gas is supplied from the gas filling line 21 to the filling passage 41. On the other hand, the check valve 51 shuts off the filling passage 41 owing to a pressure of the gas which is to flow from the gas container 1 to the upstream side of the filling passage 41. In consequence, the counter flow of the gas is inhibited.

The manual valve 52 is positioned on the downstream side of the check valve 51, and an operating portion of the manual valve to be manually operated by a user is positioned outside the container body 2. It is to be noted that, as shown in a circuit diagram, this operating portion is actually positioned so as to protrude from an outer wall surface of the housing 31. When the user operates the operating portion to close the manual valve 52, the filling passage 41 is shut off. It is to be noted that, instead of the manual valve 52, an electrically driven valve such as an electromagnetic valve may be disposed. The manual valve 52 may be omitted.

The filter 61 includes a filter element having a filtering degree in accordance with sizes of foreign matters as targets in the gas. Examples of the foreign matters include contamination and an oil content in addition to dust. Since the foreign matters can be removed from the gas by the filter 61, a clean gas can be discharged to the gas discharge line 22. Since the filter 61 is disposed on the most upstream side of the discharge passage 42, attachment of the foreign matters to valve bodies and valve seats of the shut-off valve 62, the manual valve 63 and the pressure regulation valve 64 on the downstream side of the filter is prevented.

The shut-off valve 62 functions as a source valve of the gas container 1, and is positioned, for example, in the container body 2. The shut-off valve 62 is connected to a control device (not shown), and controlled to open and close in response to an output signal from the control device. This type of shut-off valve 62 is constituted of an electrically driven valve such as an electromagnetic valve to be driven by a solenoid, an electromotive valve to be driven by a motor or a valve to be driven by an electric or magnetic force of a piezoelectric element, a magnetostrictive element or the like.

For example, the shut-off valve 62 constituted of the electromagnetic valve includes a solenoid as a driving source, a valve rod driven by the solenoid to move forwards and backwards, and the valve seat with respect to which the valve rod comes close or away, although any of these components is not shown. Moreover, when the valve rod is energized by the solenoid and allowed to abut on the valve seat, the discharge passage 42 is shut off. On the other hand, when the valve rod comes away from the valve seat owing to demagnetization of the solenoid, the discharge passage 42 is allowed to communicate.

An operating portion of the manual valve 63 to be manually operated by the user is positioned outside the container body 2. It is to be noted that, as shown in the circuit drawing, this operating portion is actually positioned so as to protrude from the outer wall surface of the housing 31. When the user operates the operating portion to close the manual valve 63, the discharge passage 42 is shut off. It is to be noted that, instead of the manual valve 63, an electrically driven valve such as the electromagnetic valve may be used. Alternatively, the manual valve 63 may be omitted.

The pressure regulation valve 64 (a regulator) reduces the pressure of the gas flowing through the discharge passage 42 to a predetermined pressure. The pressure regulation valve 64 may be constituted by an operation system of a direct driving type or a pilot type. The pressure regulation valve 64 may be configured to control the pressure in a mechanical system or constituted as, for example, an electropneumatic regulator. The pressure regulation valve 64 is positioned outside the container body 2, and an operating portion for regulating an open valve characteristic of the pressure regulation valve is positioned so as to protrude from the outer wall surface of the housing 31. Therefore, the open valve characteristic of the pressure regulation valve 64 can be regulated with a satisfactory operability.

One end of the communication path 44 is connected to the downstream side of the manual valve 52 in the filling passage 41 (or the downstream side as viewed from the check valve 51), and the other end of the communication path is connected to the downstream side of the shut-off valve 62 in the discharge passage 42 (or the downstream side as viewed from the manual valve 63) which is the upstream side of the pressure regulation valve 64. That is, a connection combining point 71 between the communication path 44 and the filling passage 41 is disposed on the downstream side of the manual valve 52, and a connection combining point 72 between the communication path 44 and the discharge passage 42 is disposed between the shut-off valve 62 and the pressure regulation valve 64. The communication path 44 is provided with a shut-off valve 74 capable of opening and closing this communication path.

Figure 6:
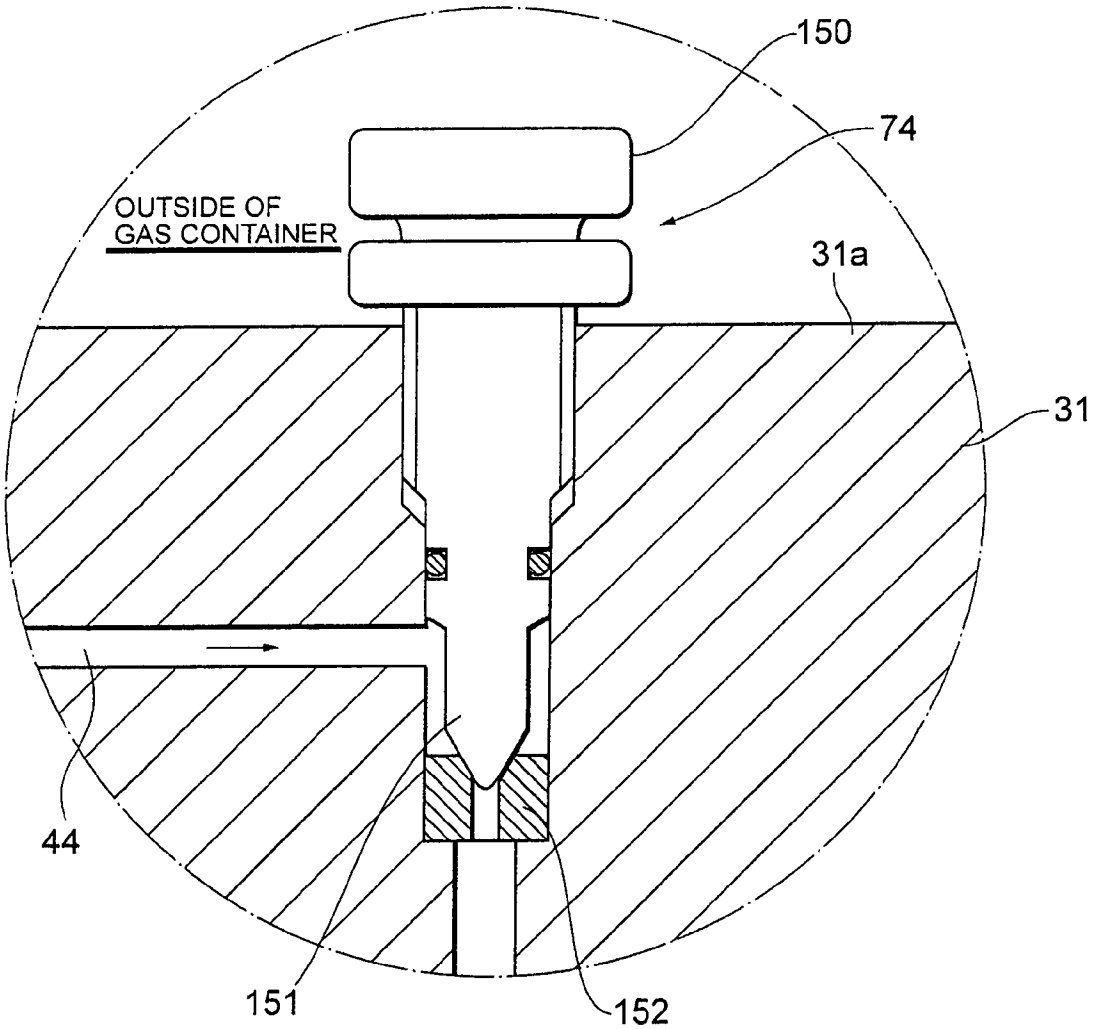
FIG. 6 is an enlarged sectional view of a shut-off valve corresponding to a communication shut-off mechanism.

The shut-off valve 74 (a communication shut-off mechanism) may be constituted of an electrically driven valve in the same manner as in the shut-off valve 62 in the discharge passage 42, or may be constituted in the same manner as in the manual valve 63 in the discharge passage 42. As shown in FIG. 6, the shut-off valve 74 of the present embodiment is constituted of a manual valve, and has a manual operating portion 150 for operating and closing the communication path 44 by a manual operation. The manual operating portion 150 is connected to a valve body 151. When the manual operating portion 150 is operated, the valve body 151 comes away from or comes in contact with a valve seat 152. This type of manual operating portion 150 may be constituted of a lever, a button of a push-pull operation system, or a circular handle to be rotatably operated.

The manual operating portion 150 is positioned outside the container body 2, and disposed so as to protrude from an outer wall surface 31*a* of the housing 31. Therefore, the user can easily access the manual operating portion 150 without detaching the valve assembly 10 from the mouthpiece 3. When the user operates the manual operating portion 150 to open the shut-off valve 74, the filling passage 41 is allowed to communicate with the discharge passage 42. On the other hand, when the shut-off valve 74 is closed, the filling passage 41 is allowed to communicate with the discharge passage 42. As described later, the shut-off valve 74 constantly closes, and is opened mainly during a failure of the shut-off valve 62 or the like.

A valve having any function is applicable to the shut-off valve 74. Examples of a type of the shut-off valve 74 include a gate valve, a globe valve, a butterfly valve and a ball valve. For example, when the filling passage 41 crosses the discharge passage 42 at right angles in the housing 31 and the passages do not extend in parallel with each other, the shut-off valve 74 may be constituted of the globe valve of an angle valve type or a Y-shaped valve type.

Here, an operation of the valve assembly 10 of the present embodiment will be described.

To fill the gas container 1 with the gas, the manual valve 52 is opened and thereby the gas is introduced into the storage space 5 from the gas filling line 21 via the filling passage 41. At this time, the shut-off valve 74 disposed at the communication path 44 is closed, and the gas flowing through the filling passage 41 does not flow into the discharge passage 42 via the communication path 44. After completion of the filling with the gas, the manual valve 52 is closed. It is to be noted that the filling passage 41 is provided with the check valve 51. Therefore, even if the manual valve 52 is not closed after the completion of the filling with the gas, the gas can be inhibited from being discharged from the filling passage 41.

To discharge the gas from the gas container 1, the shut-off valve 62 and the manual valve 63 are opened. The shut-off valve 62 is opened, when electrically controlled by the control device (not shown), based on a request for the power generation in, for example, the fuel cell system. The manual valve 63 may be opened in advance before the gas is discharged. When the shut-off valve 62 and the manual valve 63 are opened, the gas stored in the storage space 5 flows through the discharge passage 42, the pressure of the gas is reduced by the pressure regulation valve 64 and the gas is discharged to the gas discharge line 22. At this time, the shut-off valve 74 disposed at the communication path 44 is closed, and the gas flowing through the discharge passage 42 does not flow into the filling passage 41 via the communication path 44.

In addition, the shut-off valve 62 sticks and does not open, or a control circuit is disconnected and the shut-off valve 62 is not opened. The shut-off valve 62 does not open owing to such a failure or the like in some case. In such a case, the valve assembly 10 needs to be detached from the mouthpiece 3 in order to inspect or replace the shut-off valve 62. If the gas container 1 remains to be filled with the gas, this detaching operation becomes laborious. Therefore, the gas needs to be discharged from the gas container 1. However, in this case, since the shut-off valve 62 does not open owing to the failure or the like, the gas cannot be discharged to the downstream side of the discharge passage 42 through the filter 61 and the shut-off valve 62 of the discharge passage 42.

To solve the problem, in the present embodiment, the shut-off valve 74 on the communication path 44 is opened, and the filling passage 41 is allowed to communicate with the discharge passage 42 in order to discharge the gas from the discharge passage 42. In consequence, as shown by a flow of the gas with a broken-line arrow in the drawing, the gas stored in the storage space 5 flows through the filling passage 41 to flow into the communication path 44, and flow into the downstream side of the discharge passage 42 from the communication path 44.

In consequence, even if the shut-off valve 62 does not open owing to the failure or the like, the gas can appropriately be discharged from the gas container 1 via the discharge passage 42 by effectively using the filling passage 41. To discharge the gas, the gas flowing through the discharge passage 42 passes through the pressure regulation valve 64. Therefore, the pressure of the gas is reduced, and the gas can be discharged from the gas container 1. It is to be noted that this gas discharged during the failure maybe used in, for example, the power generation of the fuel cell of the fuel cell system. After concentration of the gas discharged during the failure is reduced with a diluting gas (air or an inactive gas), the gas may be discharged to the atmosphere. Alternatively, the concentration may be reduced by an oxidation reaction on a catalyst.

On the other hand, conversely to the above-mentioned disadvantage, the shut-off valve 62 sticks and does not close, or the control circuit is disconnected and cannot close the shut-off valve 62. In this manner, the shut-off valve 62 does not close owing to the failure or the like in some case. In such a case, when the manual valve 63 on the downstream side of the shut-off valve 62 is closed, the gas can be inhibited from being discharged from the storage space 5 to the gas discharge line 22. However, needless to say, during occurrence of this disadvantage, the shut-off valve 74 disposed at the communication path 44 needs to be closed. When the pressure of the gas container 1 abnormally rises as described above, the relief valve 46 can be opened to discharge the gas from the gas container 1 via the relief passage 43, and damages on the gas container 1 can be avoided.

It is to be noted that in the above description, the shut-off valve 74 is constituted of the manual valve, but an operation system of the valve may be changed, and the shut-off valve 74 may be constituted of, for example, a foot valve. That is, the shut-off valve 74 may be constituted of a man-powered valve such as the manual valve or the foot valve. This also applies to the manual valve 52 and the manual valve 63.

Second Embodiment

Figure 2:
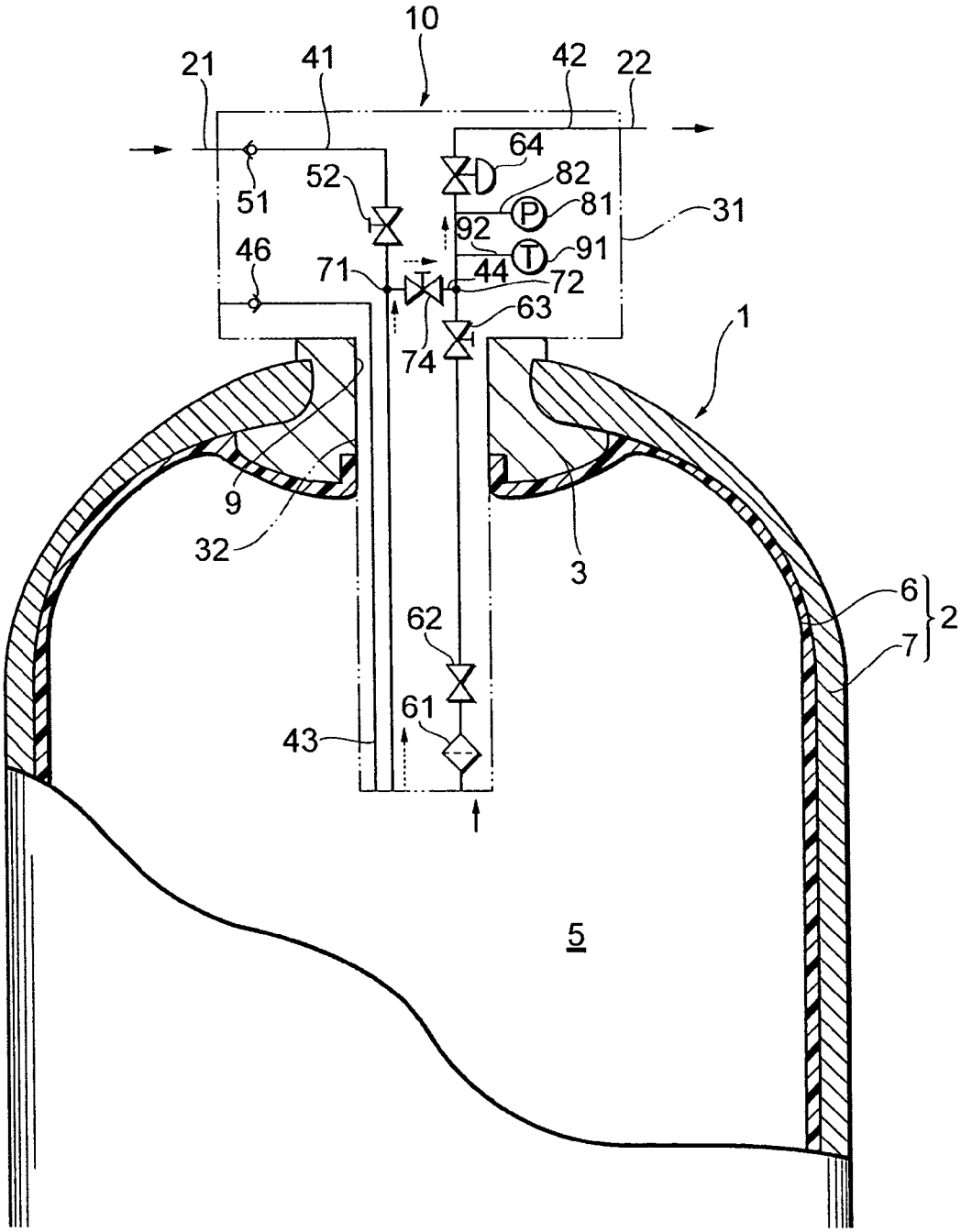
FIG. 2 is a diagram, which is similar to FIG. 1, showing a constitution of a valve assembly for a gas container according to a second embodiment.

Next, a different respect of a valve assembly 10 according to a second embodiment will mainly be described with reference to FIG. 2. The embodiment is different from the first embodiment in that a discharge passage 42 is provided with a pressure sensor 81 and a temperature sensor 91.

The pressure sensor 81 is disposed on a downstream side of a connection combining point 72 between the discharge passage 42 and a communication path 44 which is an upstream side of a pressure regulation valve 64. Since the pressure sensor 81 is positioned on a primary side of the pressure regulation valve 64, the pressure sensor 81 can detect a pressure of the gas of a storage space 5. The pressure sensor 81 is attached to a passage 82 disposed so as to branch sideward from the discharge passage 42. An attaching portion between the pressure sensor 81 and the passage 82 is sealed with a seal member (not shown).

Similarly, the temperature sensor 91 is disposed on the downstream side of the connection combining point 72 between the discharge passage 42 and the communication path 44 which is the upstream side of the pressure regulation valve 64. The temperature sensor 91 can detect a temperature of the gas of the storage space 5. The temperature sensor 91 is attached to a passage 92 disposed so as to branch sideward from the discharge passage 42. An attaching portion between the temperature sensor 91 and the passage 92 is sealed with a seal member (not shown).

According to the present embodiment, an amount of the gas to fill a gas container 1 can be calculated by the pressure sensor 81 and the temperature sensor 91. If the gas leaks from the pressure sensor 81 or the attaching portion (the sealed portion) between the pressure sensor 81 and the passage 82, a shut-off valve 62 can be closed to inhibit the gas leakage. Similarly, if the gas leaks from the temperature sensor 91 or the attaching portion between the temperature sensor 91 and the passage 92, the shut-off valve 62 can be closed to inhibit the gas leakage. Therefore, a seal structure for the pressure sensor 81 and the temperature sensor 91 can be simplified.

It is to be noted that a positional relation between the pressure sensor 81 and the temperature sensor 91 may be reversed. The pressure sensor 81 and the temperature sensor 91 may be disposed at any position on the downstream side of the shut-off valve 62, for example, on the upstream side of the connection combining point 72 between the discharge passage 42 and the communication path 44. One of the pressure sensor 81 and the temperature sensor 91 may be omitted.

Third Embodiment

Figure 3:
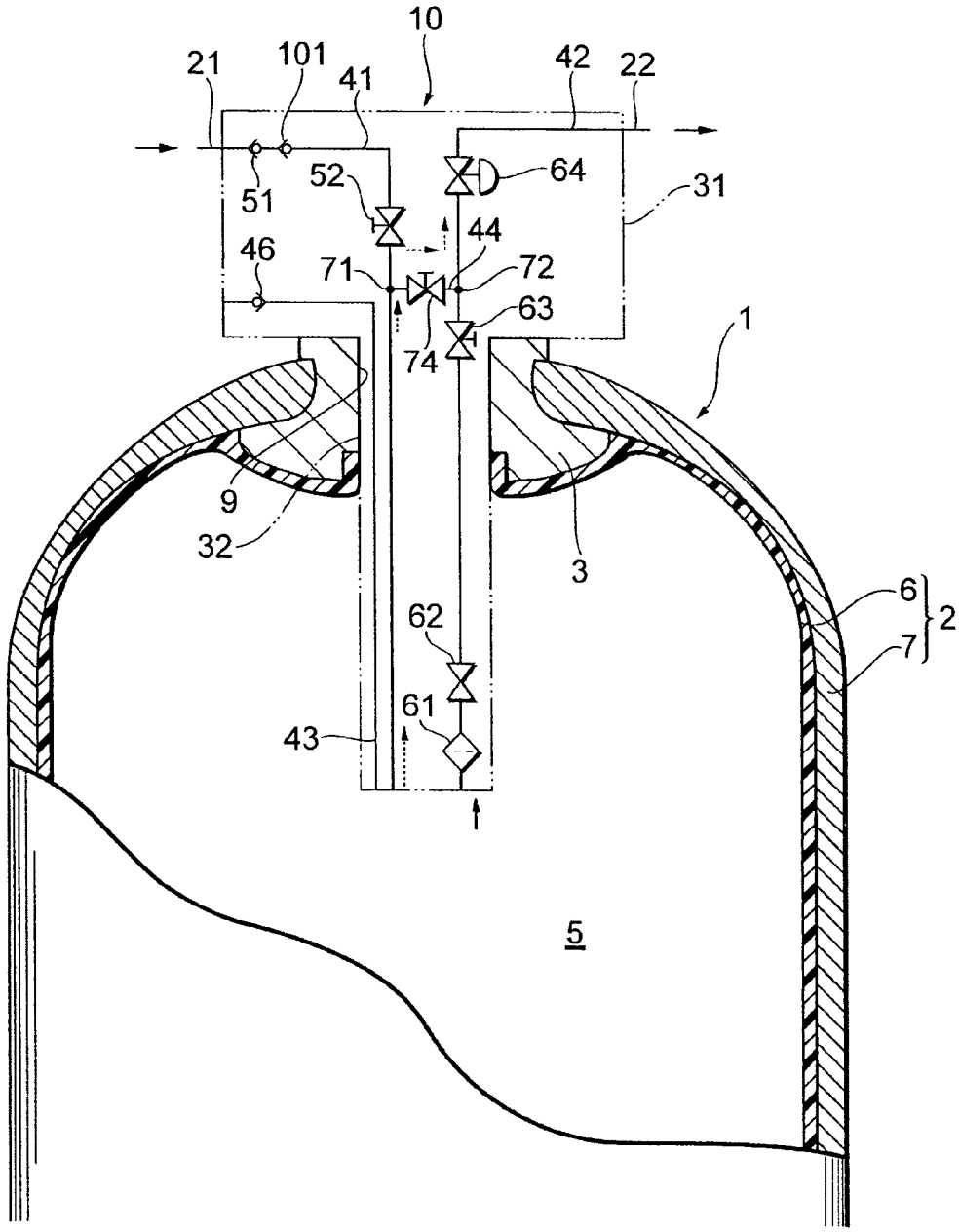
FIG. 3 is a diagram, which is similar to FIG. 1, showing a constitution of a valve assembly for a gas container according to a third embodiment.

Next, a different respect of a valve assembly 10 according to a third embodiment will mainly be described with reference to FIG. 3. The embodiment is different from the first embodiment in that a check valve 101 (a filling-side valve) is added to a filling passage 41.

That is, two check valves 51, 101 having a similar function are arranged in series at the filling passage 41. According to such a constitution, even if outflow of gas as a counter flow cannot be inhibited owing to a failure of one (51 or 101) of the check valves, the counter flow of the gas can be inhibited by the other check valve (101 or 51). It is to be noted that it is preferable to set a minimum operation pressure of the check valve 101 on a downstream side to be smaller than that of the check valve 51 on an upstream side. The filling passage 41 may be provided with two or more check valves.

Fourth Embodiment

Figure 4:
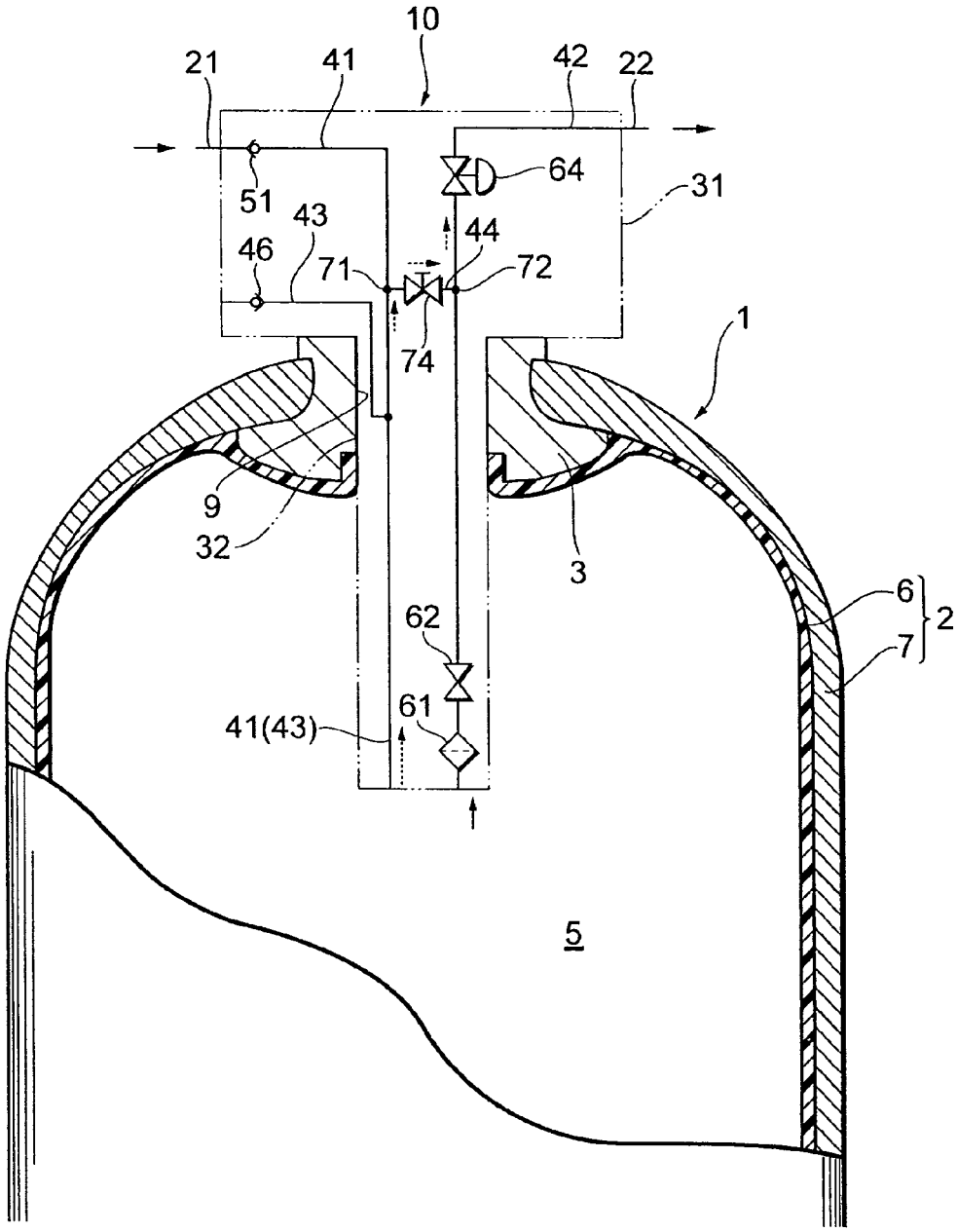
FIG. 4 is a diagram, which is similar to FIG. 1, showing a constitution of a valve assembly for a gas container according to a fourth embodiment.

Next, a different respect of a valve assembly 10 according to a fourth embodiment will mainly be described with reference to FIG. 4. The embodiment is different from the first embodiment in that a relief passage 43 is connected to a filling passage 41 so as to be branched from the passage.

One end of the relief passage 43 opens to the outside of a housing 31, and the other end of the relief passage is connected to the filling passage 41. A branch connection point between the relief passage 43 and the filling passage 41 is positioned on a downstream side of a check valve 51. According to such a constitution, as compared with first to third embodiments, a degree of freedom in arrangement of various valves (51, 52, 62, 63, 64 and 74) of passages (41 to 44) can be increased. Moreover, a size of the whole valve assembly 10 can be reduced. It is to be noted that in FIG. 4, the manual valve 52 of the filling passage 41 and the manual valve 63 of the discharge passage 42 are omitted.

Fifth Embodiment

Figure 5:
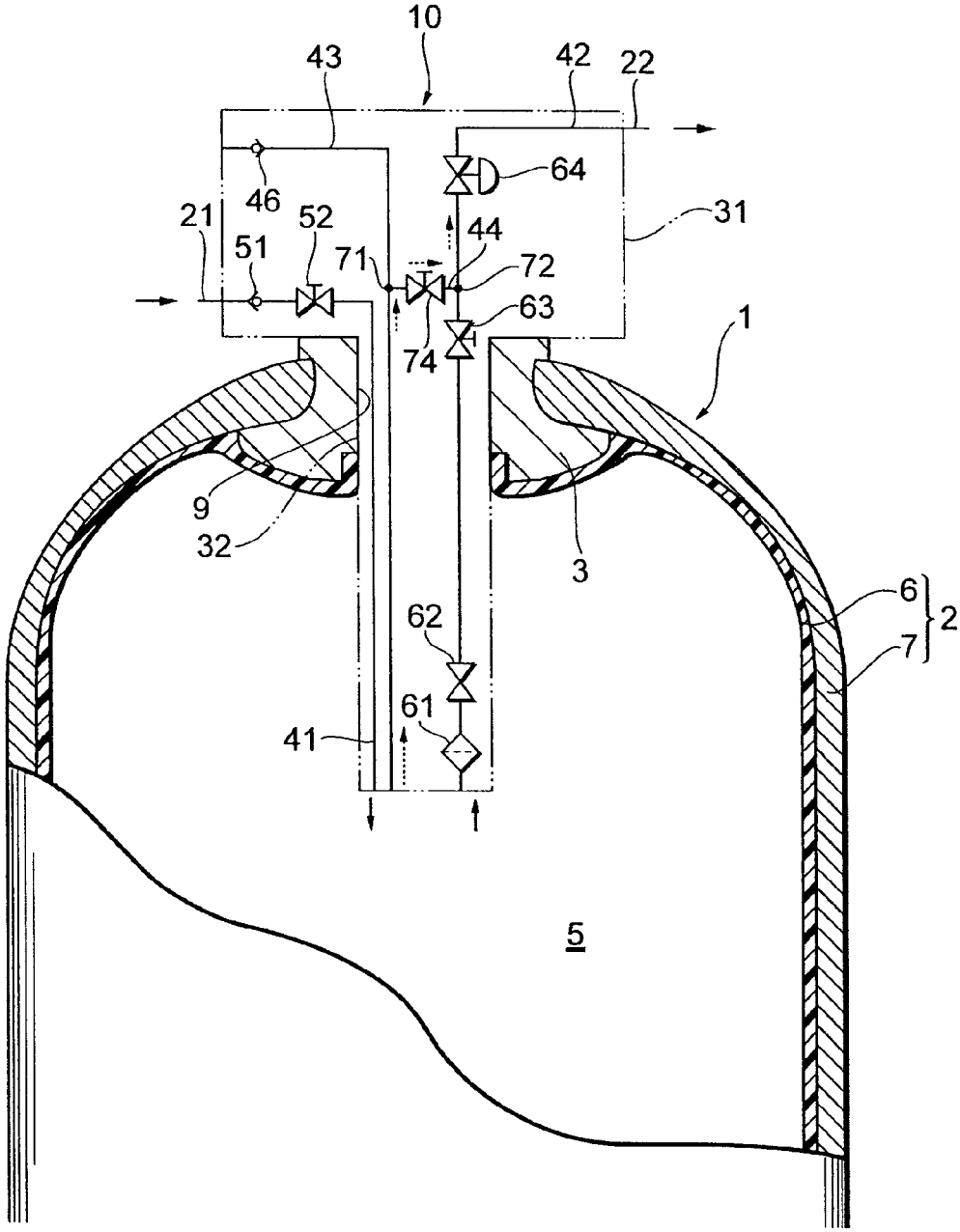
FIG. 5 is a diagram, which is similar to FIG. 1, showing a constitution of a valve assembly for a gas container according to a fifth embodiment.

Next, a different respect of a valve assembly 10 according to a fifth embodiment will mainly be described with reference to FIG. 5. The embodiment is different from the first embodiment in that a relief passage 43 is connected to a discharge passage 42 via a communication path 44, and accordingly the filling passage 41 is disposed independently of the discharge passage 42.

One end of the communication path 44 is connected to a portion on an upstream side from a relief valve 46 (a first valve), that is, a portion of the relief passage 43 on a storage space 5 side as viewed from the relief valve 46. The other end of the communication path 44 is connected to a downstream side of a shut-off valve 62 in the discharge passage 42 which is the upstream side of a pressure regulation valve 64 in the same manner as described above. The communication path 44 is provided with a shut-off valve 74 (a communication shut-off mechanism) capable of opening and closing this communication path in the same manner as described above.

According to the present embodiment, even if the shut-off valve 62 does not open owing to a failure or the like, the shut-off valve 74 disposed at the communication path 44 can be opened to allow the relief passage 43 to communicate with the discharge passage 42. In consequence, as shown by a flow of a gas with a broken-line arrow in the drawing, the gas stored in the storage space 5 flows through the relief passage 43 to flow into the communication path 44, and flows into the discharge passage 42 on the downstream side from the communication path 44. Even if the shut-off valve 62 does not open owing to the failure or the like, the gas can appropriately be discharged from a gas container 1 via the discharge passage 42 by effectively using the relief passage 43 as in the present embodiment.

Another Embodiment

As described above in the first to fifth embodiments, communication between a filling passage 41 (or a relief passage 43) and a discharge passage 42 is shut off by a shut-off valve 74. However, a communication shut-off mechanism may be constituted which is capable of shutting off and allowing the communication.

An example will be described with reference to FIG. 1. The communication shut-off mechanism may be constituted of two shut-off valves (not shown) disposed on an upstream side and a downstream side of a connection combining point 71 in the filling passage 41, and two shut-off valves (not shown) disposed on an upstream side and a downstream side of a connection combining point 72 in the discharge passage 42. The above shut-off valve 62 is applicable to the shut-off valve on the upstream side of the connection combining point 72 in the discharge passage 42. When these four shut-off valves are appropriately opened or closed during discharging of a gas in a case where the shut-off valve 62 does not open in addition to filling with the gas and discharging of the gas, the above specification of the valve assembly 10 can be achieved.

INDUSTRIAL APPLICABILITY

According to the present invention described above, a gas container 1 including a valve assembly 10 is preferably used in a vehicle and the like on which a fuel cell system is mounted. The gas container 1 of the present invention is preferably applicable to transport facilities such as an airplane and a ship in which the gas container is used as a power source, in addition to the vehicle.

The invention claimed is:

1. A valve assembly for a gas container having a storage space, the valve assembly being disposed at the gas container, the valve assembly comprising:

a filling passage to fill the storage space of the gas container with gas and a discharge passage to discharge the gas from the storage space, the passages, which both extend into the storage space of the gas container, allow the inside of the gas container to communicate with the outside;

a filling-side valve disposed at the filling passage, the filling-side valve configured to shut off the filling passage and prevent flow in a downstream direction, the downstream direction being the direction in which the gas flows into the gas container when the gas container is being filled from the outside;

a discharge-side valve disposed at the discharge passage, the discharge-side valve configured to shut off the discharge passage;

a communication path between the discharge passage and the filling passage, wherein the discharge passage connects to the communication path by a first continuously-open connection portion at a downstream side of the discharge-side valve, wherein the filling passage connects to the communication path by a second continuously-open connection portion to a downstream side of the filling-side valve;

a single shut-off valve in the communication path; and a bypass path that forms when the shut-off valve in the communication path is opened with the filling-side valve closed, the bypass path allowing the gas stored inside the gas container to flow backwards through at least a portion of the filling passage, through the communication path, through at least a portion of the discharge passage, and to the exterior of the valve assembly.

2. The valve assembly for the gas container according to claim 1, wherein the shut-off valve is a man-powered valve.

3. The valve assembly for the gas container according to claim 2, wherein the shut-off valve is a manual valve having a manual operating portion which opens and closes the communication path, and the manual operating portion is disposed outside the gas container.

4. The valve assembly for the gas container according to claim 1, wherein the discharge passage is provided with a pressure regulation valve on a downstream side of the first continuously-open connection portion.

5. The valve assembly for the gas container according to claim 4, further comprising: a sensor disposed at the discharge passage on an upstream side of the pressure regulation valve, the sensor detecting a state quantity of the gas.

6. The valve assembly for the gas container according to claim 1, wherein the discharge passage is provided with a sensor which detects a state quantity of the gas on the downstream side of the discharge-side valve.

7. The valve assembly for the gas container according to claim 1, wherein the filling-side valve is a man-powered valve.

8. The valve assembly for the gas container according to claim 1, further comprising: a plurality of filling-side valves, the plurality of filling-side valves including check valves arranged in series in the filling passage.

9. The valve assembly for the gas container according to claim 1, wherein the discharge-side valve is an electrically driven valve.

10. The valve assembly for the gas container according to claim 1, further comprising: a plurality of discharge-side valves, the plurality of discharge-side valves including an electrically driven valve and a man-powered valve positioned on a downstream side of the electrically driven valve.

11. The valve assembly for the gas container according to claim 1, wherein the discharge-side valve is a source valve of the gas container.

12. The valve assembly for the gas container according to claim 1, wherein the discharge passage is provided with a filter on an upstream side of the discharge-side valve.

13. The valve assembly for the gas container according to claim 1, further comprising:

a relief valve to be opened when the gas stored in the gas container reaches a predetermined pressure or more; and a relief passage provided with the relief valve, the relief valve allowing the inside of the gas container to communicate with the outside when opening.

14. The valve assembly for the gas container according to claim 13, wherein the relief passage is a passage connected to the filling passage so as to be branched from the filling passage, and the filling-side valve is positioned on an upstream side of a branch connection point between the relief passage and the filling passage.

15. The valve assembly for the gas container according to claim 1, further comprising: a housing having the filling passage, the discharge passage, the filling-side valve, the discharge-side valve, the communication path, and the shut-off valve in the communication path.

16. The valve assembly for the gas container according to claim 1, wherein the filling passage allows the inside of the gas container to communicate with a gas filling line in a fuel cell system, and the discharge passage allows the inside of the gas container to communicate with a gas discharge line which discharges the gas to a fuel cell in the fuel cell system.

17. The valve assembly for the gas container according to claim 1, wherein the gas is a high-pressure combustible gas.

18. The valve assembly for the gas container according to claim 17, wherein the high-pressure combustible gas is a hydrogen gas.

19. The valve assembly for the gas container according to claim 17, wherein the high-pressure combustible gas is a compressed natural gas.

20. The valve assembly for the gas container according to claim 1, wherein the gas container has a container body in which the gas is stored and a mouthpiece attached to the container body, and the valve assembly for the gas container is disposed at the mouthpiece.

21. The valve assembly for the gas container according to claim 20, wherein the valve assembly is screwed into the mouthpiece to be disposed.

22. A valve assembly for a gas container having a storage space, the valve assembly being disposed at the gas container, comprising:

a discharge passage of a gas which allows the inside of the gas container to communicate with the outside;

a first gas passage which allows the inside of the gas container to communicate with the outside and which is different from the discharge passage;

a discharge-side valve which is disposed at the discharge passage and which is configured to shut off the discharge passage;

a first valve which is disposed at the first gas passage and which is configured to shut off the first gas passage;

a communication path between the discharge passage and the first gas passage, wherein the discharge passage connects to the communication path by a first continuously-open connection portion at a portion of the discharge passage outside the gas container as viewed from the discharge-side valve, wherein the first gas passage connects to the communication path by a second continuously-open connection portion to a portion of the first gas passage in the gas container as viewed from the first valve;

a single shut-off valve in the communication path; and a bypass path that forms when the shut-off valve in the communication path is opened, the bypass path allowing the gas stored in the gas container to flow backwards in the following order: through at least a portion of the first gas passage, through the communication path, through at least a portion of the discharge passage, and to the exterior of the valve assembly wherein the first gas passage is a relief passage which discharges the gas when the gas stored in the gas container reaches a predetermined pressure or more, and wherein the discharge gas passage and the first gas passage both extend into the storage space of the gas container.

* * * * *

UNITED STATES PATENT AND TRADEMARK OFFICE

CERTIFICATE OF CORRECTION

PATENT NO. : 8,573,253 B2
APPLICATION NO. : 11/884129
DATED : November 5, 2013
INVENTOR(S) : N. Ogami et al.

It is certified that error appears in the above-identified patent and that said Letters Patent is hereby corrected as shown below:

On the Title Page of the patent, at Item (86), please change PCT No. from "PCT/JP2006/003516" to

--PCT/JP2006/303516--.

Signed and Sealed this
Thirteenth Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,573,253 B2
APPLICATION NO. : 11/884129
DATED : November 5, 2013
INVENTOR(S) : Ogami et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1276 days.

Signed and Sealed this
Twenty-second Day of September, 2015

Michelle K. Lee

Michelle K. Lee
*Director of the United States Patent and Trademark Office*